United States Patent [19]

Drechsel

[11] Patent Number: 4,669,669

[45] Date of Patent: Jun. 2, 1987

[54] HIGH-PERFORMANCE NOZZLE FOR IRRIGATORS

[76] Inventor: Arno Drechsel, 29, Wia Weggenstein, I-39100 Bolzano, Italy

[21] Appl. No.: 580,389

[22] Filed: Feb. 15, 1984

[30] Foreign Application Priority Data

Mar. 4, 1983 [IT] Italy ..... 46816 A/83

[51] Int. Cl.[4] ..... B05B 1/02

[52] U.S. Cl. ..... 239/590.5

[58] Field of Search ..... 239/589, 590, 590.3, 239/590.5, 601, 597, 428.5, 461

[56] References Cited

U.S. PATENT DOCUMENTS

| | | | |
|---|---|---|---|
| 359,602 | 3/1887 | Gray | 239/602 |
| 1,202,506 | 10/1916 | Galloway | 239/428.5 |
| 2,196,169 | 4/1940 | Twombly | 239/461 |
| 2,220,227 | 11/1940 | Gifford | 239/602 X |
| 2,731,299 | 1/1956 | Bramming | 239/590.5 |
| 4,013,230 | 3/1977 | Gondek | 239/590.3 X |
| 4,055,302 | 10/1977 | Hruby, Jr. | 239/590.5 X |
| 4,129,257 | 12/1978 | Eggert | 239/460 X |
| 4,216,913 | 8/1980 | Troup | 239/601 X |
| 4,460,130 | 7/1984 | Baumann et al. | 239/601 X |

FOREIGN PATENT DOCUMENTS

| | | | |
|---|---|---|---|
| 1111087 | 10/1981 | Canada | 239/590.5 |
| 523104 | 7/1940 | United Kingdom . | |

*Primary Examiner*—Andres Kashnikow
*Assistant Examiner*—Mary Beth O. Jones
*Attorney, Agent, or Firm*—Birch, Stewart, Kolasch & Birch

[57] ABSTRACT

A high-performance nozzle for irrigators comprises a first frusto-conical portion extending from the inlet section to an intermediate section, a flat annular shoulder orthogonal to the nozzle axis, and a cylindrical outlet portion, the ratio of the outer diameter to the inner diameter of the annular shoulder being between 1.8 and 1.3.

1 Claim, 6 Drawing Figures

HIGH-PERFORMANCE NOZZLE FOR IRRIGATORS

BACKGROUND OF THE INVENTION

1. Field of the Invention

High-performance irrigator devices able to propel a water spray to a distance of between 10 and 100 meters are known in the irrigation field.

2. Description of the Prior Art

These spray irrigator devices, also known as impact irrigators, operate with a throughput up to 50 liters/-second and a pressure up to 10 atm or 10.3323 kg/cm$^2$.

One of the main problems of these machines is that they distribute the water jet poorly when below a certain pressure, so that the water jet, which remains undivided, causes serious damage to crops.

The best known irrigators have an internal profile which blends smoothly with the cross-section of the irrigator propelling tube at its outlet section, and although they offer the best results in terms of range, they operate properly with regard to atomisation and jet dispersion only above about 4 atm. or 4.13292 kg/cm$^2$ pressure. This means that on start-up, the jet remains undivided until this pressure is reached, and excavates a groove in the soil.

To obviate this drawback, those delivery nozzles which have their internal profile smoothly blending with the cross-section of the propelling tube at the nozzle outlet section are generally associated with a jet breaker device in the form of a small cone or a point, which is inserted orthogonally into a small portion of the jet downstream of the jet outlet section.

In addition to constituting a definite constructional complication, the presence of this device is also damaging when the jet reaches normal operating pressure.

There is therefore a widely felt need for a delivery nozzle having a configuration such that it offers good jet dispersion starting from a pressure of the order of 2–3 atm. or 2.06648–3.0969 kg/cm$^2$, in order to prevent crop damage.

SUMMARY OF THE INVENTION

Attempts have been made in this sense consisting of replacing the profiled nozzle of known type with a simple annular diagragm, but although this has given good results in terms of water distribution even at lower pressure, it has not been acceptable in that it leads to a range reduction, for equal operating conditions, of up to about 20% with respect to the range of the profiled nozzle.

The object of the present invention is to provide a nozzle of special configuration, which ensures excellent water distribution even at very low pressure, but which results in only a small range reduction with respect to the maximum obtainable with profiled nozzles.

This is attained according to the invention by a nozzle comprising a first portion of decreasing cross-section, a constriction determined by a flat annular shoulder orthogonal to the nozzle axis, and a portion of constant cross-section which is equal substantially to the outlet cross-section of the nozzle.

According to the invention, the degree of taper of the first portion of decreasing cross-section is not critical, and obviously depends on the ratio of the cross-section of the irrigator propelling tube to the required nozzle outlet cross-section.

In contrast, what is critical according to the invention is the dimension of the flat shoulder, in the form of a circular rim, which suddenly reduces the cross-section of the nozzle to the required cross-section, this latter remaining unchanged as far as the outlet section.

In this respect, it has been surprisingly noted that if the ratio of the outer diameter to the inner diameter of the shoulder is kept between 1.8 and 1.3, ranging from the most constricted nozzles to the nozzles of least constriction respectively, excellent jet distribution is already obtained at a pressure of 2 atm. or 2.06646 kg/cm$^2$, with a range of 97–94% of the range of a smoothly blended nozzle for equal operating conditions.

The average optimum value of said ratio is about 1.5.

In addition, the invention provides the following overall dimentionsal data for a nozzle of the proposed configuration;

- outlet diameter between 0.4 and 0.8 times the diameter of the propelling tube;
- length of the cylindrical terminal portion not less than 0.8 times the outlet diameter, and preferably equal to this latter, but not greater than 2.5 times the outlet diameter.

It has also been noted that in a nozzle of the proposed configuration, the true outlet diameter is about 20% greater than the theoretical outlet diameter for the purposes of calculating the throughput.

BRIEF DESCRIPTION OF THE DRAWINGS

The merits and constructional and operational characteristics of the invention will be more apparent from the detailed description given hereinafter with reference to the figures of the accompanying drawings, which illustrate two particular embodiments by way of non-limiting example.

DESCRIPTION OF THE PREFERRED EMBODIMENTS

Figure 1:
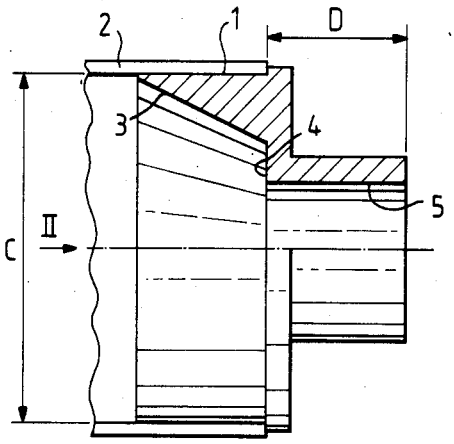
FIG. 1 is an axial section through a first embodiment of the invention.
Figure 2:
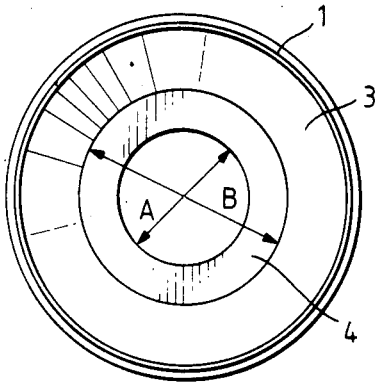
FIG. 2 is a view in the direction II of FIG. 1.

In the figures, the same reference letters and numerals indicate corresponding nozzle parts in both the illustrated embodiments.

The figures show a nozzle comprising a first externally cylindrical portion 1 for exact insertion into the propelling tube 2 of diameter C, and having an interior of frusto-conical configuration 3 which extends from the propelling tube to the outer edge, of diameter B, of an annular shoulder 4 orthogonal to the jet axis and having an inner diameter A corresponding to the required outlet cross-section.

A cylindrical portion 5 of constant cross-section and of length D extends from the inner edge of the shoulder and opens to the outside.

Figure 3:
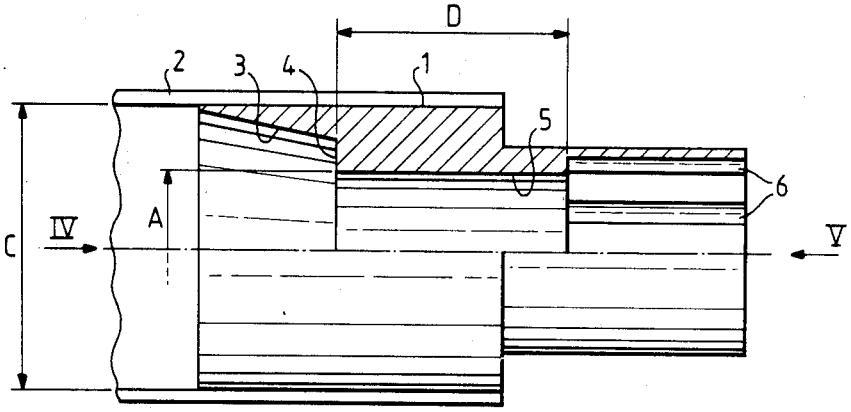
FIG. 3 is an axial section through a second embodiment of the invention.
Figure 4:
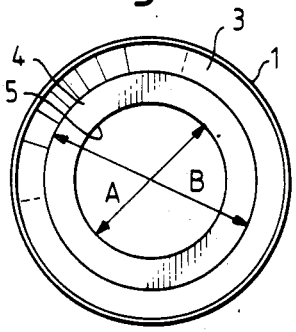
FIG. 4 is a view in the direction of IV of FIG. 3.
Figure 5:
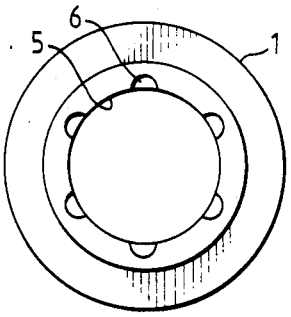
FIG. 5 is a view in the direction of V of FIG. 3.

In the embodiment of FIGS. 3, 4 and 5, it can be seen that the final cylindrical portion of the nozzle extends into a slightly widened portion which has its inner surface provided with equidistant axial grooves 6 having a dead-ended semicylindrical configuration. It has been noted in practice that the axial dead ended grooves 6 ensure an excellent water distribution at very low pressures.

The following Table 1 gives by way of example the dimensional data for a series of nozzles conforming to that of FIG. 1.

Table 2 shows the performance of said nozzles compared with the performance of corresponding smoothly blending nozzles (in parentheses).

TABLE 1

| | | | | |
|---|---|---|---|---|
| Ø | 20 | 25 | 30 | 35 |
| A | 26 | 32 | 37 | 42 |
| B | 47 | 53 | 56 | 57 |

C = 60 (mm)

D = 40 (mm)

Ø = nominal diameter (mm)

A, B in (mm)

TABLE 2

| Ø | P | 2.5 | 3 | 4 | 5 |
|---|---|---|---|---|---|
| 20 | g | 36.8 (–) | 39.2 (40.5) | 43.5 (45.0) | 46.5 (48.0) |
| | p | 6.6 (–) | 7.2 (7.3) | 8.4 (8.4) | 9.3 (9.3) |
| 25 | g | 42.8 (–) | 45.2 (47.0) | 49.5 (51.5) | 52.4 (54.5) |
| | p | 10.4 (–) | 11.3 (11.3) | 13.0 (13.0) | 14.6 (14.6) |
| 30 | g | 48.3 (–) | 50.7 (53.0) | 55.0 (57.5) | 57.8 (61.0) |
| | p | 14.9 (–) | 16.3 (16.3) | 18.8 (18.8) | 21.0 (21.0) |
| 35 | g | 52.7 (–) | 55.1 (58.0) | 59.5 (62.5) | 62.2 (65.5) |

TABLE 2-continued

| Ø | P | 2.5 | 3 | 4 | 5 |
|---|---|---|---|---|---|
| | p | 20.4 (–) | 22.2 (22.2) | 25.6 (25.6) | 28.6 (28.6) |

P = operating pressure (kg/cm$^2$)
p = throughput (liters/sec)
g = range (m)
Ø = nominal diameter (mm)

Figure 6:
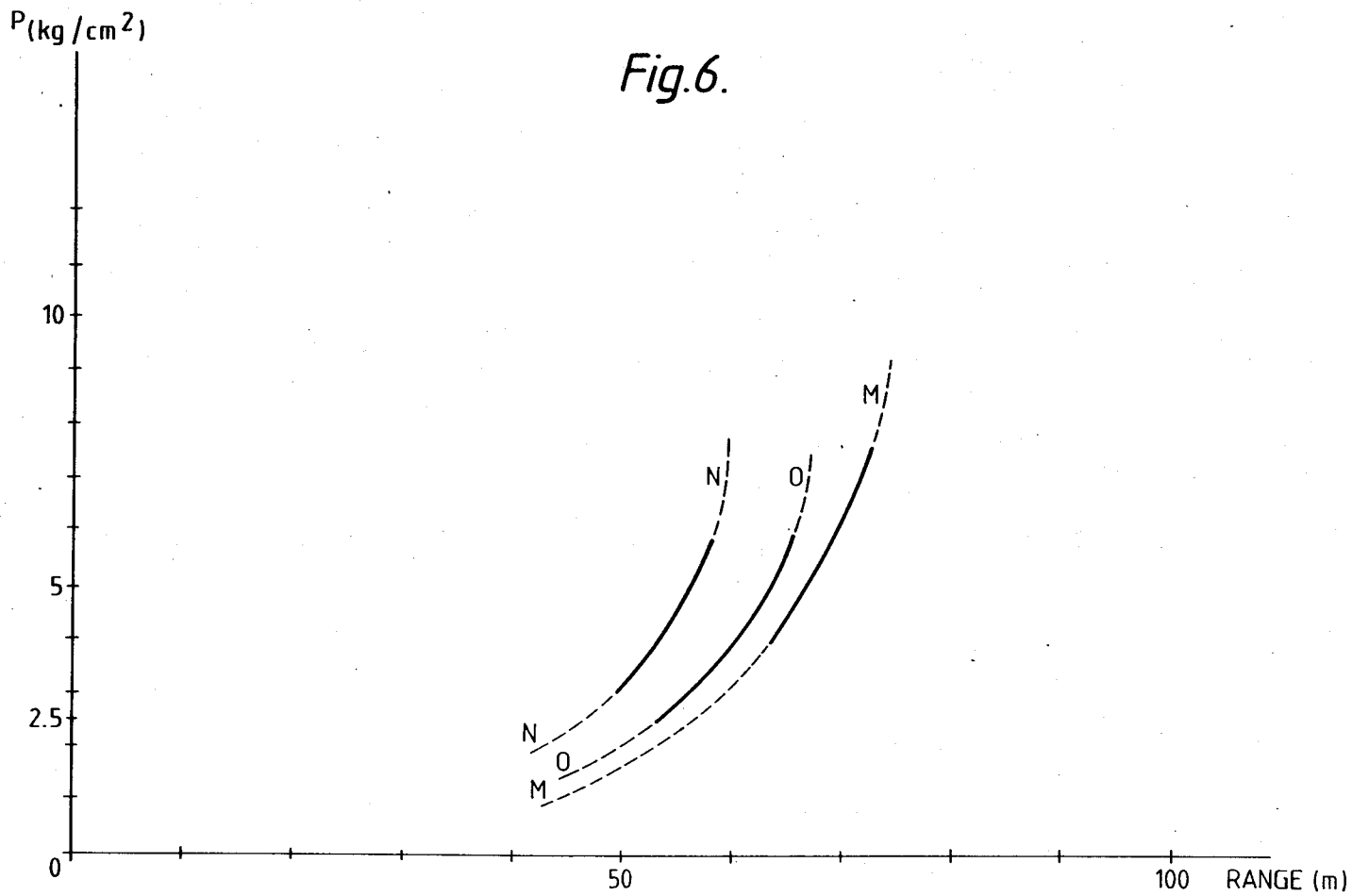
FIG. 6 is a comparative diagram of the operation of the various types of nozzle.

FIG. 6 shows the pressure/range diagrams, on which the full lines indicate the ranges of proper operation of a normal smoothly blended nozzle (M), a diaphragm nozzle (N) and a nozzle according to the invention (O).

From the aforegoing it is apparent that by virtue of the teachings of the invention, the problem of atomising the jet is solved starting from a very low operating pressure, with only small penalties in terms of throughput.

The invention is not limited only to the embodiments heretofore described, and modifications and improvements can be made thereto but without leaving the scope of the inventive idea, the fundamental characteristics of which are summarised in the following claims.

I claim:

1. A high-performance nozzle for irrigators comprising:

a longitudinal axis, an inlet portion having a frusto-conical shape decreasing in diameter from an inlet end, an intermediate portion connected to said inlet portion, said intermediate portion shaped as a flat annular shoulder, a cylindrical outlet portion connected to said intermediate portion, said cylindrical outlet portion is connected to a further portion, said further portion is of slightly greater diameter and is provided with a series of axial dead-ended grooves.

* * * * *